United States Patent [19]

Barclay et al.

[11] 4,278,512

[45] Jul. 14, 1981

[54] LOW CONCENTRATION TRIVALENT CHROMIUM ELECTROPLATING SOLUTION AND PROCESS

[75] Inventors: Donald J. Barclay; James M. L. Vigar, both of Winchester, England

[73] Assignee: International Business Machines Corporation, Armonk, N.Y.

[21] Appl. No.: 86,092

[22] Filed: Oct. 18, 1979

[30] Foreign Application Priority Data

Nov. 11, 1978 [GB] United Kingdom ..... 44177/78
Sep. 18, 1979 [GB] United Kingdom ..... 32300/79

[51] Int. Cl.[3] ..... C25D 3/10; C25D 5/14
[52] U.S. Cl. ..... 204/41; 204/51
[58] Field of Search ..... 204/51, 43 R, 41

[56] References Cited

U.S. PATENT DOCUMENTS

| | | | |
|---|---|---|---|
| 4,062,737 | 12/1977 | Barclay et al. | 204/43 R |
| 4,141,803 | 2/1979 | Barclay et al. | 204/51 |
| 4,161,432 | 7/1979 | Barclay et al. | 204/51 |

OTHER PUBLICATIONS

Donald J. Barclay et al., Inorganic Chemistry, vol. 9, No. 5, pp. 1024–1030, (1970).

*Primary Examiner*—G. L. Kaplan
*Attorney, Agent, or Firm*—Francis A. Sirr

[57] ABSTRACT

A very low concentration (below 0.03 M) trivalent chromium plating bath in which the source of chromium is an equilibrated aqueous solution of a chromium (III) - thiocyanate complex gives a deposit of unexpectedly light color. Such a bath is employed to produce thin overcoatings of light colored chromium for decorative applications. The bath and process is also used to plate the initial layer of a thick (greater than 5 micron) deposit for engineering applications, the major part of which is plated from a higher chromium concentration bath. Such thick deposits from a higher concentration bath are more cohesive and smoother when plated over an initial layer from the low concentration bath.

14 Claims, No Drawings

LOW CONCENTRATION TRIVALENT CHROMIUM ELECTROPLATING SOLUTION AND PROCESS

DESCRIPTION

1. Field of the Invention

This invention relates to chromium electroplating solutions and processes in which the source of chromium comprises an aqueous solution of a chromium (III)-thiocyanate complex.

2. Background Art

Conventionally chromium has been plated from aqueous chromic acid baths prepared from chromic oxide ($CrO_3$) and sulphuric acid. Such baths, in which the chromium is in hexavalent form are characterized by low current efficiency. The chromic acid fumes emitted as a result of hydrogen evolution also present a health hazard. Furthermore, the concentration of chromium in such baths is extremely high, leading to problems of waste or recovery because of so-called "drag-out" of chromium compounds into the rinse tanks which follow the plating bath.

To overcome many of the disadvantages of hexavalent chromium plating, it has been proposed to plate chromium in trivalent form. One such process for plating chromium from an aqueous solution of a chromium (III)-thiocyanate complex is described in UK Pat. No. 1,431,639 and its equivalent U.S. Pat. No. 4,062,737.

Another such process is described in U.S. Pat. No. 4,161,432 which describes a chromium plating solution and process in which an aqueous solution of a chromium (III)-thiocyanate complex is again employed but in which a buffer material supplies one of the ligands to the chromium complex. The buffer material is selected from amino acids (e.g. glycine, aspartic acid), peptides, formates, acetates and hypophosphites.

These trivalent chromium plating processes do not give off chromic acid fumes. They are of high efficiency with a wide plating range and good covering power. A lower amount of chromium is needed in the bath than is the case with hexavalent processes thus reducing the problems associated with drag-out. Concentrations of chromium have ranged from 0.03 to 0.5 Molar.

SUMMARY OF THE INVENTION

Although the trivalent chromium plating processes of U.S. Pat. Nos. 4,062,737 and 4,161,432 overcome the major disadvantages of hexavalent plating, the appearance of the deposited chromium is generally somewhat darker. While this color is quite acceptable or even preferable for many applications, it would be advantageous in decorative application to plate lighter colored chromium with a trivalent process.

Chromium plating, besides its decorative applications, is also used for engineering purposes where color may be unimportant. Because of its hardness, low friction and corrosion resistance it is used to provide, for example, a wear resistant coating on the surface of a sliding machine part or to provide such a coating on screws or bolts. For such applications, it is generally necessary that the thickness of the plated chromium is very much greater than in decorative applications.

Typically decorative chromium is less than one micron in thickness whereas "engineering" chromium needs to be of the order of tens of microns of thickness. Such thicknesses have hitherto been achievable only with hexavalent chromium plating. Attempts to plate thick chromium (above 5 microns) from trivalent baths such as those of U.S. Pat. Nos. 4,062,737 and 4,161,432 have resulted in coarse, matt deposits with poor cohesion. Thus, two problems exist with trivalent chromium from thiocyanate baths, namely of color for decorative applications and of thickness for engineering applications.

The basis of the present invention is the unexpected discovery that chromium (III)-thiocyanate baths whose chromium concentration is far below the generally accepted level for efficiency and bath stability not only give a significantly lighter colored deposit, but also a deposit which enables the subsequent deposition of smooth coherent thick layers from a higher concentration bath.

Accordingly, the present invention provides a chromium electroplating solution in which the source of chromium comprises an aqueous solution of a chromium (III)-thiocyanate complex, the concentration of chromium being less than 0.03 M and sufficiently low to be capable of producing a deposit of a color substantially as light or lighter than an evaporated chromium deposit.

The present invention provides a chromium electroplating solution in which the source of chromium comprises an equilibrated aqueous solution of a chromium (III)-thiocyanate complex, the chromium concentration being less than or equal to 0.02 Molar.

The preferred ratio of the molar concentrations of chromium to thiocyanate is between 1:2 and 1:4.

Another feature of the invention is that the solution includes an amino acid as a buffer material. The preferred amino acid is aspartic acid in molar concentration 1.25 times that of chromium.

The invention also provides a process of plating chromium comprising the step of passing an electric plating current between an anode and a cathode in such a plating solution. The preferred temperature range for achieving a light color is 40° to 60° C. Again for the lightest color it is preferred that the current density is greater than 50 $mAcm^{-2}$.

The overall process of plating chromium for engineering applications in thicknesses above 5 microns which involves plating an initial layer from a solution according to the present invention followed by one or more layers from a high concentration chromium III-thiocyanate bath is the subject of UK patent application No. 7922791.

DETAILED DESCRIPTION

In studies which have been carried out, chromium has been plated, according to the invention, from solutions of chromium-thiocyanate-amino acid complexes in which the concentration of the complexes is very low. Aspartic acid and glycine are amino acids which have been employed. Bright, white coherent deposits have been obtained from solutions of chromium concentration up to 0.02 M. These deposits are significantly lighter in color than deposits from 0.1 M solutions of the same complexing solutions. The color of the deposit to the eye is as light as that of an evaporated chromium deposit. This subjective impression is supported by reflectivity measurements which show that deposits from baths having chromium concentrations up to 0.02 M were generally equally or more reflective than evaporated chromium though less reflective than electroplated hexavalent chromium.

The color of the deposit has been found to be dependent to some extent on other factors besides chromium concentration. In particular the deposit is lighter the lower the ratio of thiocyanate to chromium.

The deposit color has also been found to lighten with increased solution temperature, 40°-60° C. giving the lightest deposits without causing other adverse effects. Increased current density has also been found to lighten the deposit.

Some experiments have shown deposits from a 0.03 M bath to be significantly darker than evaporated chromium though still lighter than trivalent bath deposits from higher concentration baths. It is not possible to give a precise quantitative limit between 0.02 and 0.03 M chromium concentration below which light deposits can be produced because, as discussed above, the color depends to some extent upon the composition of the remainder of the solution and upon the process conditions. However, isolated experiments and purely visual observations indicate that by careful optimization of variables, reflectivity or color approximating to that of evaporated chromium could be obtained from trivalent solutions of chromium concentration approaching 0.03 M.

Samples of brass, and evaporated copper on glass have been plated from the low chromium concentration solutions, and the darker deposit obtained from a higher concentration trivalent chromium bath has also been overplated from the low concentration solutions. In the latter case, the primary bath was optimized for current efficiency and stability over a long period rather than for color. A bath optimized for light color would be somewhat inefficient and slow and would need frequent careful replenishment if used to plate thicknesses of chromium which are normally required commercially. Besides the lighter color of the overplated coating, it has been found that the corrosion resistance of overplated samples is superior to samples which have not been overplated.

Process conditions have been varied widely and satisfactory plating still obtained. Baths have been operated at temperatures from 20°-70° C. and current densities in a Hull cell have ranged from 20-800 $mAcm^{-2}$.

Studies of the parameters affecting the efficiency of the low chromium concentration bath indicate that both current density and solution pH have an effect. The optimum current density is 30-40 $mAcm^{-2}$ for efficiency although a current density above 50 $mAcm^{-2}$ produces a still lighter color. A pH range of 3.8-4.5 is generally the most efficient though any pH between 2 and 5 is acceptable and there is no marked effect on color.

Chromium has also been plated, according to the invention, as the first step of a process for plating thick (greater than 5 micron) coatings for engineering applications where color is not as important as surface qualities such as smoothness, hardness and coherence. Such thick coatings, plated predominantly from a higher chromium concentration bath are found to have improved properties where an initial thin layer is deposited from a solution and by a process according to the present invention. Again, although a thick coating with good surface qualities could in theory be plated from a low concentration bath, the time involved would be very long and the efficiency very low.

ESCA measurements of the deposit from low chromium concentration solutions according to the invention indicate unexpectedly that the chromium is substantially not chemically bound with any other codeposited elements whereas deposits from high chromium concentration solutions include a significant amount of chromium which is chemically bound with oxygen and sulphur. It is believed that, since the initial thin layer is very pure and uniform, it can act as a seeding layer for subsequent deposits from a higher concentration solution and limits the granularity of the resultant hybrid deposit. The overall thick film is thus more cohesive and less friable than film of the same thickness deposited from the higher concentration bath alone. The light color of the deposited chromium from low concentration solutions according to the invention is also believed to be related to the presence of chemically unbound chromium.

The invention will now be described further with refence to the following examples and comparative examples:

COMPARATIVE EXAMPLE I

This is an example of a trivalent chromium bath optimized for efficiency and lifetime rather than color. It is not an example of the invention as such but may be used to carry out the first step of a process according to one aspect of the invention.

A chromium plating solution was prepared in the following manner:

(a) 60 grams of boric acid ($H_3BO_3$) were added to 750 ml of deionized water which was then heated and stirred to dissolve the boric acid.

(b) 33.12 grams of chromium sulphate ($Cr_2(SO_4)_3.15H_2O$) and 32.43 grams of sodium thiocyanate (NaNCS) were added to the solution which was then heated and stirred at approximately 70° C. for about 30 minutes.

(c) 16.625 grams of DL aspartic acid ($NH_2CH_2CH(COOH)_2$) were added to the solution which was then heated and stirred at approximately 75° C. for about 3 hours. During this time the pH was adjusted from pH 1.5 to pH 3.0 very slowly with 10% by weight sodium hydroxide solution. Once the pH of 3.0 was achieved it was maintained at this value for the whole of the equilibration period.

(d) Sufficient sodium chloride was added to the solution to make it approximately 1 M concentration and 0.1 grams of FC 98 (a wetting agent produced by 3 M Corporation) was also added. The solution was heated and stirred for a further 30 minutes.

(e) The solution pH was again adjusted to pH 3.0 with sodium hydroxide solution.

(f) The solution was made up to 1 liter with deionized water which had been adjusted to pH 3.0 with 10% by volume of hydrochloric acid.

The final solution is of the following composition:

0.1 M chrome sulphate-$Cr_2(SO_4)_3.15H_2O$
0.4 M sodium thiocyanate-NaNCS
0.125 M aspartic acid-$NH_2CH_2CH(COOH)_2$
60 g/l boric acid-$H_3BO_3$
60 g/l sodium chloride-NaCl
0.1 g/l FC 98-(wetting agent product of 3M Corp)

As a result of the equilibration process, the bulk of the chromium in the final solution is believed to be in the form of chromium/thiocyanate/aspartic complexes.

An electroplating bath containing the above electroplating solution was operated at around pH 2.1 and 25° C. to plate chromium onto a nickel plated brass plate connected as cathode in a Hull cell. The current density was 50 $mAcm^{-2}$ and current was applied for 2 minutes.

A relatively dark deposit of chromium approximately 0.35 microns thick was produced.

EXAMPLE I

This example is an example of an electroplating solution according to the invention which was made up as follows:

A solution was prepared in exactly the same manner as described in Comparative Example I except that one-half the quantity of sodium thiocyanate was used, resulting in a sodium thiocyanate concentration of 0.2 M. 30 mls of this solution were made up to 1 liter with a solution containing 60 grams per liter of boric acid and 60 grams per liter of sodium chloride.

The final electroplating solution had essentially the following composition:

0.003 M chrome sulphate
0.006 M sodium thiocyanate
0.00375 M aspartic acid
60 g/l boric acid
60 g/l sodium chloride A plate which had been plated with chromium as described in Comparative Example I was transferred without rinsing to a second Hull cell which contained the electroplating solution of the present example. The increase in concentration of chromium due to drag-out from the first solution was not precisely determined but is estimated not to have increased the concentration by more than 0.001 M. Plating current was passed through the cell for 2 minutes. Because of the arrangement of the plate in the cell, the current densities across the plate ranged from 20 to approximately 150 $mAcm^{-2}$. The temperature of the bath was 25° C. A bright white coherent deposit was formed which obscured the initial deposit obtained from the bath of Comparative Example I. The thickness of the overplated deposit was estimated to be a few hundred angstroms.

EXAMPLE II

A sample plate was plated in the manner described in Comparative Example I. The plate was transferred without rinsing to a second solution as described in Example I and partially immersed therein. A thin layer of chromium was plated on the immersed portion of the plate in the manner described in Example I. The overplated layer obscured the originally plated layer and was significantly lighter in color than the portion of the originally plated layer which was not overplated.

Measurements were made with a spot meter of ambient reflected light intensity from the surface of the overplated (light) area and the singly plated (dark) area of the plate. Similar measurements were also made on light reflected from a specular evaporated chromium reflector and also from a white diffuse reflector. These were used as standards. By comparing the measured light intensity from the reflectors and from the light and dark areas of the sample plate, it was found that the reflectance ratio of light to dark areas of the sample plate was 2.26 to 1.

EXAMPLE III

A number of chromium plating solutions were made up as described in Example I, except that each solution had a different chromium concentration. In each case the molar ratio of chromium/thiocyanate/aspartic acid was 1/4/1.25.

The chromium was plated onto a substrate consisting of an evaporated copper layer on glass at a current density of 50 $mAcm^{-2}$. The temperature of the solution during plating lay in the range 40°±5° C. Measurements of the percentage reflectivity of the plated samples at various wavelengths were made using a Beckman Spectrophotometer Acta MVI with 198900 double-beam variable angle specular reflectance accessory. The standard used was a magnesium fluoride overcoated aluminized glass mirror. The results are given in the following table of percentage reflectivity:

| Cr Concentration | 550nm | 800nm | 350nm | 725nm |
|---|---|---|---|---|
| .001M | 62.2 | 77.7 | 62.2 | 71.1 |
| .003M | 66.2 | 77.7 | 65 | 70.8 |
| .005M | 64 | 75.7 | 61.8 | 68.3 |
| .010M | 62.1 | 73.7 | 58.8 | 66.7 |
| .015M | 60 | 71.6 | 56.6 | 64.8 |
| .020M | 56.6 | 68.5 | 51.2 | 61.9 |

By way of comparison another table gives identically obtained percentage reflectivity figures for higher chromium concentration trivalent plated samples, for a hexavalent chromium plated sample and for an evaporated chromium sample:

| Sample | 550nm | 800nm | 350nm | 725nm |
|---|---|---|---|---|
| Trivalent (.03M) | 35.7 | 44.3 | 30.1 | 39.9 |
| Trivalent (.04M) | 23.1 | 32.2 | 16.3 | 28.2 |
| Hexavalent | 73.7 | 80.9 | 82.5 | |
| Evaporated | 57.7 | 63.3 | 61.1 | |

The hexavalent samples were commercially obtained and were on different substrates which may have affected the reflectivity measurements. A relatively stronger short wavelength (blue) component was noted. The evaporated samples were produced by evaporation onto copper/glass substrates identical to those used for plating.

It can be seen that the reflectivity of the trivalent chromium is roughly as good or better than that of evaporated chromium up to a concentration of 0.02 M. At 0.03 M and above, the reflectivity of the plated samples is significantly lower than that of evaporated chromium under the plating conditions of this example. From other isolated experiments and purely visual observations of color, it seems probable that by careful optimization of other solution components, such as thiocyanate, and of process conditions such as temperature and current density, a reflectivity approximately to that of evaporated chromium could be obtained from trivalent solutions of chromium concentration approaching 0.03 M. However, no precise limit can be given.

EXAMPLE IV

In one further set of experiments a number of chromium plating solutions according to the invention were made up in the manner of Example I with a chromium concentration of 0.003 M and with thiocyanate concentrations ranging between 0.020 and 0.160 M. In all cases the aspartic acid concentration was 0.00375 M. Deposits of chromium were plated from each of these solutions under the same conditions as for Example III. Percentage reflectivity measurements were made on each plated sample and the results were as follows:

| NCS Concentration | 550nm | 800nm | 350nm | 725nm |
|---|---|---|---|---|
| .020 | 62.2 | 74.3 | 57 | 67.3 |
| .040 | 56.3 | 69.8 | 46.4 | 62.8 |
| .080 | 53.1 | 64.9 | 48.1 | 58.3 |
| .100 | 52.8 | 64.4 | 48.5 | 57.8 |
| .120 | 46.3 | 56.9 | 42.6 | 50.9 |

It can be seen that excess thiocyanate reduces the percentage reflectivity but that the effect is gradual. Even when the thiocyanate molar concentration is fifty times that of the chromium molar concentration the percentage reflectivity is still better than from the 0.03 M solution of Example III.

EXAMPLE V

In a further set of experiments a number of chromium plating solutions of different concentrations were made up in the manner of Example I. The molar ratio of chromium to thiocyanate to aspartic acid was 1:4:1.25. Each solution was pH adjusted to pH 3.0 and a number of samples were plated from each solution at different current current densities. In all cases the bath temperature was 45° C. The results were as follows:

| Cr Concentration | Current Density $mAcm^{-2}$ | % Efficiency |
|---|---|---|
| | 20 | 1 |
| | 30 | 3 |
| .003 M | 40 | 3.5 |
| | 80 | 1.5 |
| | 120 | 1.5 |
| | 180 | 1 |
| | 20 | 7 |
| | 30 | 7 |
| .007 M | 40 | 9 |
| | 80 | 4 |
| | 120 | 3 |
| | 180 | 2.3 |
| | 15 | |
| | 20 | 15 |
| | 30 | 22 |
| .022 M | 40 | 23 |
| | 80 | 11.6 |
| | 120 | 9 |
| | 180 | 5.6 |
| | 20 | 1 |
| | 30 | 10 |
| .030 M | 40 | 25.6 |
| | 80 | 12 |
| | 120 | 10.7 |
| | 180 | 6.6 |

These results show that the optimum current density for plating efficiency is in the range 30–40 $mAcm^{-2}$. However, visual observation indicates that current densities above 50 $mAcm^{-2}$ produced the lightest colors.

EXAMPLE VI

In a further set of experiments, two chromium plating solutions of 0.003 M and 0.012 M were made up in the manner of Example I. The molar ratio of chromium to thiocyanate to aspartic acid was 1:4:1.25.

Samples of each solution were adjusted to different pH's by addition of acids or bases and the effect of pH variation studied by plating deposits of chromium. In each case the temperature was maintained at 45° C. and the plating current density was 40 $mAcm^{-2}$. The results were as follows:

| Cr Concentration | pH | % Efficiency |
|---|---|---|
| | 2.0 | 3.0 |
| 3mM | 3.0 | 2.5 |
| | 3.8 | 3.6 |
| | 4.5 | 3.0 |
| | 2.0 | 5.2 |
| 12mM | 3.0 | 5.9 |
| | 3.8 | 6.4 |
| | 4.5 | 7.6 |

The results were not completely consistent but generally indicate that a pH in the range 3.8–4.5 is the most efficient. There was no marked effect on color.

COMPARATIVE EXAMPLE II

A solution prepared as in Comparative Example I (i.e. with 0.1 M chromium concentration) was introduced into a plating cell. A platinized titanium anode and a steel sample panel as cathode were immersed in the cell. The steel panel had an overcoating of 10–12 microns of bright nickel. A plating current of 75 $mAcm^{-2}$ was passed between the electrodes for 90 minutes. A layer of chromium of 20.9 microns thickness was deposited.

This deposit was dull and matt in appearance and provided to be extremely friable. Profile measurements of the surface gave a center line average measurements in the range 62–75 microinches (1.5–1.9 microns).

EXAMPLE VII

A second lower concentration chromium (0.003 M) plating solution, according to the invention, was made up as described in Example I.

The lower concentration electroplating solution was introduced into a plating cell having a platinized titanium anode and a steel sample panel as cathode. In a process according to the invention, a plating current of 40 $mAcm^{-2}$ was passed through the cell for 240 seconds to deposit an initial layer of chromium estimated to be not more than 1000 angstroms in thickness.

The panel plated by a process and from a solution according to the invention was then transferred without rinsing to a second plating cell containing a higher concentration chromium electroplating solution of the same composition as that of Comparative Examples I and II. A plating current of 75 $mAcm^{-2}$ was passed through the cell for 180 minutes to deposit a much thicker layer of chromium on top of the initial thin layer. The final thickness of the chromium layer was 21.6 microns.

This thick layer appeared smooth and reflective to the eye. The CLA of the surface was 7 microinches (0.178 microns). The deposit was less friable and more cohesive than that of Comparative EXample II.

EXAMPLE VIII

The two step plating described in Example VII was repeated in a series of experiments using the same two plating solutions, although in some cases the wetting agent was omitted. This appeared to improve the characteristics of the deposit even further by reducing granularity. Films ranging from 10 to 75 microns thickness were plated. Current densities for plating from the low concentration bath were in the range 40–50 $mAcm^{-2}$. Current densities for plating from the high concentration bath were in the range 50–120 $mAcm^{-2}$.

CLA measurements on some of these samples lay in the range 7–11.2 microinches.

EXAMPLE IX

Using the same solutions as for Example VII, and starting with the lower concentration solution accordinging to the invention, alternate layers of chromium were deposited on a steel sample panel from the two solutions.

The steel panel was first connected as cathode in the low concentration bath and a current of density 40 $mAcm^{-2}$ was passed for 240 seconds to produce a thin initial layer of chromium of no more than 1000 angstroms thickness. The panel was transferred, without rinsing, to the high concentration bath and plated at a current density of 50 $mAcm^{-2}$ for 30 minutes to produce a thicker layer of chromium. The panel was then transferred back to the low concentration bath and plated for 2 minutes at 40 $mAcm^{-2}$. The alternate plating for 30 minutes in the high concentration bath and 2 minutes in the low concentration bath was continued for a total time of 215 minutes.

In all a thickness of 16.9 microns of chromium was deposited. The final deposit was cohesive, smooth and nonfriable and had a CLA of 8 microinches (0.2 microns).

While we have described preferred embodiments of our invention, it is to be understood that we do not limit ourselves to these precise disclosures and the right is reserved to all changes and modifications coming within the scope of the invention as defined in the appended claims.

What is claimed is:

1. A chromium electroplating solution in which the source of chromium comprises an equilibrated aqueous solution of chromium (III)-thiocyanate complexes, the chromium concentration being less than or equal to 0.02 Molar, said solution including an amino acid as a Ph buffer material providing at least one of the ligands for the complex.

2. A chromium electroplating solution as claimed in claim 1 wherein said amino acid is aspartic acid.

3. A chromium electroplating solution as claimed in claim 2 in which the ratio of the molar concentrations of chromium to thiocyanate is between 1:2 and 1:4.

4. A chromium electroplating solution as claimed in claim 3 in which the aspartic acid concentration is approximately 1.25 times that of chromium.

5. A process of plating chromium comprising the step of passing an electric plating current between an anode and a cathode in an electroplating solution in which the source of chromium comprises an equilibrated aqueous solution of chromium (III)-thiocyanate complexes, the chromium concentration being less than or equal to 0.02 Molar.

6. A process as claimed in claim 5 in which the temperature is in the range 40° C. to 60° C.

7. A process as claimed in claim 6 in which the current density is greater than 50 $mAcm^{-2}$.

8. A process as claimed in claim 7 in which the solution includes aspartic acid as a buffer material providing at least one of the ligands for the complex, the molar ratio of chromium/thiocyanate/aspartic acid being 1/4/1.25.

9. A process as claimed in claim 8 wherein the solution pH is in the range of 3.8–4.5.

10. A process as claimed in claim 5 in which the current density is greater than 50 $mAcm^{-2}$.

11. A process of electroplating an article with chromium comprising electroplating the article with a first relatively thick layer of chromium in a first bath in which the source of chromium comprises an aqueous solution of chromium (III)-thiocyanate complexes, the concentration of chromium being greater than 0.03 M, transferring the article without rinsing to a second plating bath, and plating a relatively thin layer of chromium over the first layer in the second bath, the initial concentration of chromium in the second bath being less than or equal to 0.02 M to give a perceptibly lighter colored layer than that of the first layer.

12. A process as claimed in claim 11 in which the plating current density in the second bath lies in the range 20 to 150 $mAcm^{-2}$.

13. A process as claimed in claim 12 in which at least one of said baths includes an amino acid as a buffer material.

14. A solution for electroplating chromium predominantly as a metal in which the source of chromium comprises an equilibrated aqueous solution of chromium (III)-thiocyanate complexes; the chromium concentration being less than or equal to 0.02 Molar; the ratio of the molar concentrations of chromium to thiocyanate being between 1:2 and 1:4; and said solution including aspartic acid as a Ph buffer material which provides at least one of the ligands for the complexes, in a molar concentration 1.25 times the concentration of chromium.

* * * * *